US007358682B2

(12) United States Patent
Matsushima

(10) Patent No.: US 7,358,682 B2
(45) Date of Patent: Apr. 15, 2008

(54) DISCHARGE LAMP LIGHTING APPARATUS

(75) Inventor: Mitsuo Matsushima, Kitasaku-gun (JP)

(73) Assignee: Minebea Co., Ltd., Kitasaku-Gun (JP)

( * ) Notice: Subject to any disclaimer, the term of this patent is extended or adjusted under 35 U.S.C. 154(b) by 0 days.

(21) Appl. No.: 11/591,614

(22) Filed: Nov. 2, 2006

(65) Prior Publication Data

US 2007/0108921 A1 May 17, 2007

(30) Foreign Application Priority Data

Nov. 14, 2005 (JP) ..... 2005-328927

(51) Int. Cl.
*H05B 37/00* (2006.01)

(52) U.S. Cl. ..... 315/239; 315/291; 315/119; 315/312

(58) Field of Classification Search ..... 315/224, 315/276, 277, 291, 209 R, 209 PZ, 307, 315/312, 308, 239, 119, 219
See application file for complete search history.

(56) References Cited

U.S. PATENT DOCUMENTS 6,114,814 A 9/2000 Shannon et al. ..... 315/219
6,570,344 B2 * 5/2003 Lin ..... 315/224
6,774,580 B2 * 8/2004 Suzuki et al. ..... 315/224
6,919,693 B2 * 7/2005 Fushimi ..... 315/219
2005/0128377 A1 * 6/2005 Park et al. ..... 349/61

FOREIGN PATENT DOCUMENTS

JP A 2005-183099 7/2005

* cited by examiner

*Primary Examiner*—Thuy V. Tran
*Assistant Examiner*—Ephrem Alemu
(74) *Attorney, Agent, or Firm*—Oliff & Berridge, PLC

(57) ABSTRACT

A discharge lamp lighting apparatus includes a transformer defining primary and secondary sides; a transformer driving circuit to drive the primary side of the transformer thereby lighting a discharge lamp connected at the secondary side of the transformer; a control circuit to control the transformer driving circuit; a high voltage capacitor formed of a pattern capacitor and disposed between one terminal of the secondary side of the transformer and the discharge lamp; and a discharge detecting pattern disposed close to the high voltage capacitor. In the discharge lamp lighting apparatus, a voltage induced in the discharge detecting pattern is duly detected, and power supply to the secondary side of the transformer is stopped.

7 Claims, 10 Drawing Sheets

DISCHARGE LAMP LIGHTING APPARATUS

BACKGROUND OF THE INVENTION

1. Field of the Invention

The present invention relates to a discharge lamp lighting apparatus for lighting a discharge lamp to illuminate a liquid crystal display device, and particularly to a discharge lamp lighting apparatus provided with a function of detecting an abnormal electrical discharge.

2. Description of the Related Art

An illumination device such as a backlight device is used in a liquid crystal display (LCD) as a display device for a liquid crystal monitor, an LCD television, and the like. A discharge lamp such as a cold cathode discharge lamp is extensively used as a light source for such an illumination device, and a discharge lamp lighting apparatus usually includes an inverter circuit provided with a step-up transformer to achieve a high AC voltage required to duly light the discharge lamp.

Conventionally, an inverter circuit for a discharge lamp lighting apparatus includes a high voltage capacitor connected at the secondary side of a transformer, and a resonant circuit is formed by the high voltage capacitor together with a leakage inductance of the transformer and a parasitic capacitance of the discharge lamp connected to the transformer as a load, wherein the primary side of the transformer is driven at the resonant frequency of the resonant circuit (refer to, for example, U.S. Pat. No. 6,114,814).

FIG. 7 is a circuitry of an example of such a discharge lamp lighting apparatus as described above. A discharge lamp lighting apparatus 50 shown in FIG. 7 includes a transformer 54 which has its primary winding connected to output terminals 51*a* and 51*b* of an H-bridge circuit (not shown), and which has its secondary winding connected to a discharge lamp 56 via a resonant circuit 59 which is composed of a leakage inductance of the transformer 54, a high voltage capacitor 58, and a parasitic capacitance (not shown) of the discharge lamp 56. In the discharge lamp lighting apparatus 50, the operating frequency of the H-bridge circuit to drive the primary side of the transformer 54 is set to the resonant frequency of the resonant circuit 59 so that the power efficiency of the transformer 54 can be enhanced.

Since an inverter circuit generally outputs a high voltage, abnormal electrical discharges can occur at the current route (including a discharge lamp) carrying an AC output from the inverter, such as: an arc discharge caused due to breakage of circuit wirings, for example, cracking at a soldered portion, defective connection at a connector, or deformation of a component or wire by an external force; a breakdown discharge found between high-voltage and low-voltage portions; and a ground discharge. An arc discharge, for example, is accompanied by sparks, which may possibly damage terminals or components, or may even give off smoke or fire. In order to address such a problem found at a discharge lamp lighting apparatus provided with a step-up transformer, there is provided a circuit to detect an abnormal discharge and also stop supply of electric power to the discharge lamp thereby preventing damages to the discharge lamp lighting apparatus and the LCD device (refer to, for example, Japanese Patent Application Laid-Open No. 2005-183099).

FIG. 8 is a block diagram of an example of such a discharge lamp lighting apparatus. Referring to FIG. 8, a discharge lamp lighting apparatus 100 includes a transformer 105, a transformer driving circuit 104 connected at the primary side of the transformer 105, and a control circuit 103 connected to the transformer driving circuit 104 and adapted to control the operation of the transformer driving circuit 104. A discharge lamp 106 is connected via its one terminal to one terminal of the secondary winding of the transformer 105 and via its other terminal to a current-voltage converting circuit 107 to convert a lamp current into a voltage. The output from the current-voltage converting circuit 107 is inputted to the control circuit 103 via a lamp current controlling pattern 108, and the control circuit 103 controls the transformer driving circuit 104 according to the output signal so as to make the lamp current stay constant. A discharge detecting pattern 111 is connected at the other terminal (ground side) of the secondary winding of the transformer 105 and arranged so as to go along and close to the lamp current controlling pattern 108.

In the discharge lamp lighting apparatus 100 described above, if a corona or arc discharge is caused at a breakage in the wiring at the secondary side of the transformer 105, a noise component is mixed into the lamp current. Due to a high frequency component included in the noise component, an induced voltage is generated in the discharge detecting pattern 111 disposed along and close to the lamp current controlling pattern 108, and is inputted to the control circuit 103 via a discharge detecting diode 112 and an integration circuit 113. Then, the control circuit 103 compares the inputted voltage with a reference voltage predetermined, and if the inputted voltage exceeds the reference voltage, the transformer driving circuit 104 is caused to stop its operation.

Thus, in the discharge lamp lighting apparatus 100, a corona or arc discharge, when caused in the circuits of the transformer 105, is duly detected, and power supply to the secondary side of the transformer 105 is disconnected to thereby stop discharging so that the discharge lamp lighting apparatus 100 and the LCD device can be protected.

In the discharge lamp lighting apparatus 50 of FIG. 7, the high voltage capacitor 58, which is a relatively costly capacitor with a high withstand voltage, is connected at the secondary side of the transformer 54, thus inviting a cost increase problem. Since a large LCD for an LCD television incorporates a backlight device using a plurality of discharge lamps in order to achieve a high brightness, the high-voltage capacitor 58 must be provided in a number corresponding to the number of discharge lamps used, which aggravates the cost increase problem.

In order to cope with the problem, a pattern capacitor, which is composed of a board as a dielectric body and electrode patterns formed on the board, may be used in place of discrete electronic components for the high voltage capacitor 58. However, in a discharge lamp lighting apparatus like the discharge lamp lighting apparatus 50 of FIG. 7, in which the transformer 54 is driven at the resonant frequency of the resonant circuit 59 (or at a specific frequency predetermined in relation to the resonant frequency), the following problem is raised in association with the usage of the pattern capacitor.

The parasitic capacitance value of the discharge lamp 56, which is affected by the distance between the discharge lamp 56 and a metal chassis having the discharge lamp 56 attached thereto, is caused to vary due to a change in the design of the metal chassis or the structure for attaching the discharge lamp 56 to the metal chassis, and accordingly the resonant frequency of the resonant circuit 59 is also caused to vary. So, when such a pattern capacitor as described above is used in place of the high-voltage capacitor 58, a design change must be implemented on the pattern capacitor according to the variation of the parasitic capacitance value of the discharge lamp 56. Consequently, whenever the parasitic capacitance of the discharge lamp 56 is changed, the pattern capacitor used as the high-voltage capacitor 58 must undergo a design change, that is to say a design change must be implemented on a circuit board, which generally requires time and cost.

Further, the discharge lamp lighting apparatus 50 also desirably has a function of detecting abnormal discharges as provided in the discharge lamp lighting apparatus 100 described with reference to FIG. 8. The function of detecting abnormal discharges in the discharge lamp lighting apparatus 100, however, is provided such that the discharge detecting pattern 111 is disposed at the ground side of the secondary side of the transformer 105 therefore failing to directly detect the high voltage portion where a discharge phenomenon is actually caused, and thus the detection accuracy is not satisfactory.

SUMMARY OF THE INVENTION

The present invention has been made in light of the problems described above, and it is an object of the present invention to provide a discharge lamp lighting apparatus, in which abnormal discharges caused at high voltage portions can be accurately detected thereby duly stopping power supply to a discharge lamp, and in which an abnormal discharge detecting pattern and a high voltage capacitor can be structured inexpensively.

In order to achieve the object described above, according to an aspect of the present invention, there is provided discharge lamp lighting apparatus, which includes: a transformer defining primary and secondary sides; a transformer driving circuit to drive the primary side of the transformer thereby lighting a discharge lamp connected at the secondary side of the transformer; a control circuit to control the transformer driving circuit; a high voltage capacitor formed of a pattern capacitor and disposed between one terminal of the secondary side of the transformer and the discharge lamp; and a discharge detecting pattern disposed close to the high voltage capacitor. In the discharge lamp lighting apparatus described above, a voltage induced in the discharge detecting pattern is duly detected, and power supply to the secondary side of the transformer is stopped.

Consequently, an abnormal discharge caused at a high voltage portion in the discharge lamp lighting apparatus can be accurately detected thereby stopping power supply to the discharge lamp. Also, since the high voltage capacitor is formed of a pattern capacitor, a plurality of high voltage capacitors can be provided in a number corresponding to the number of discharge lamps without increasing the component cost, which is suitable for use in a large LCD television.

In the aspect of the present invention, electrodes of the high voltage capacitor may be formed respectively at the both surfaces of a print board. Or alternatively, at least one electrode of the high voltage capacitor may be formed at the interface between adjacent layers of a print board, which results in that the insulation performance between the electrodes of the high voltage capacitor can be enhanced without taking the creepage distance therebetween into consideration.

In the aspect of the present invention, the discharge detecting pattern and one electrode of the high voltage capacitor may be formed on the same surface of a print board, or the discharge detecting pattern may be formed at the interface between adjacent layers of a print board so as to be sandwiched between the both electrodes of the high voltage capacitor. Also, the discharge detecting pattern may include a portion having a meandering configuration or a portion having a swirling configuration. Thus, since the discharge detecting pattern and the electrodes of the high voltage capacitor can be flexibly structured according to the wiring space available on a print board, the discharge detecting pattern can be formed with a desired inductance, which enables an efficient detection of discharges.

In the aspect of the present invention, at least one electrode of the high voltage capacitor may include a plurality of electrode patterns. With this structure, the capacitance value of the high voltage capacitor can be readily adjusted by appropriately changing the connection mode of the electrode patterns without redesigning a print board.

Accordingly, in the discharge lamp lighting apparatus described above, an abnormal discharge, which is caused at a high voltage portion, can be accurately detected so as to stop power supply to the discharge lamp, and also the discharge detecting pattern and the high voltage capacitor can be achieved inexpensively.

BRIEF DESCRIPTION OF THE DRAWINGS

FIGS. 4A to 4C are for explaining an advantage of high voltage capacitors each having one electrode thereof formed at an interface between adjacent dielectric bodies, wherein FIG. 4A is a top plan view of a print board which includes two high voltage capacitors, and which has a slit formed between the two high voltages capacitors, FIG. 4B is a cross sectional view of a print board which is composed of one dielectric body, and which has upper and lower electrodes formed respectively on both outer surfaces of the one dielectric body, and FIG. 4C is a cross sectional view of a print board which is composed of two dielectric bodies, and which has an upper electrode formed on an outer surface of one of the two dielectric bodies and a lower electrode formed at an interface between the two dielectric bodies so as to be fully enclosed;

FIGS. 5A and 5B are bottom views of print boards, showing respective different examples of discharge detecting patterns in the discharge lamp lighting apparatus according to the present invention, wherein FIG. 5A shows a pattern put in a meandering configuration, and FIG. 5B shows a pattern swirling around an electrode;

DETAILED DESCRIPTION OF THE INVENTION

An exemplary embodiment of the present invention will hereinafter be described with reference to the accompanying drawings.

Figure 1:
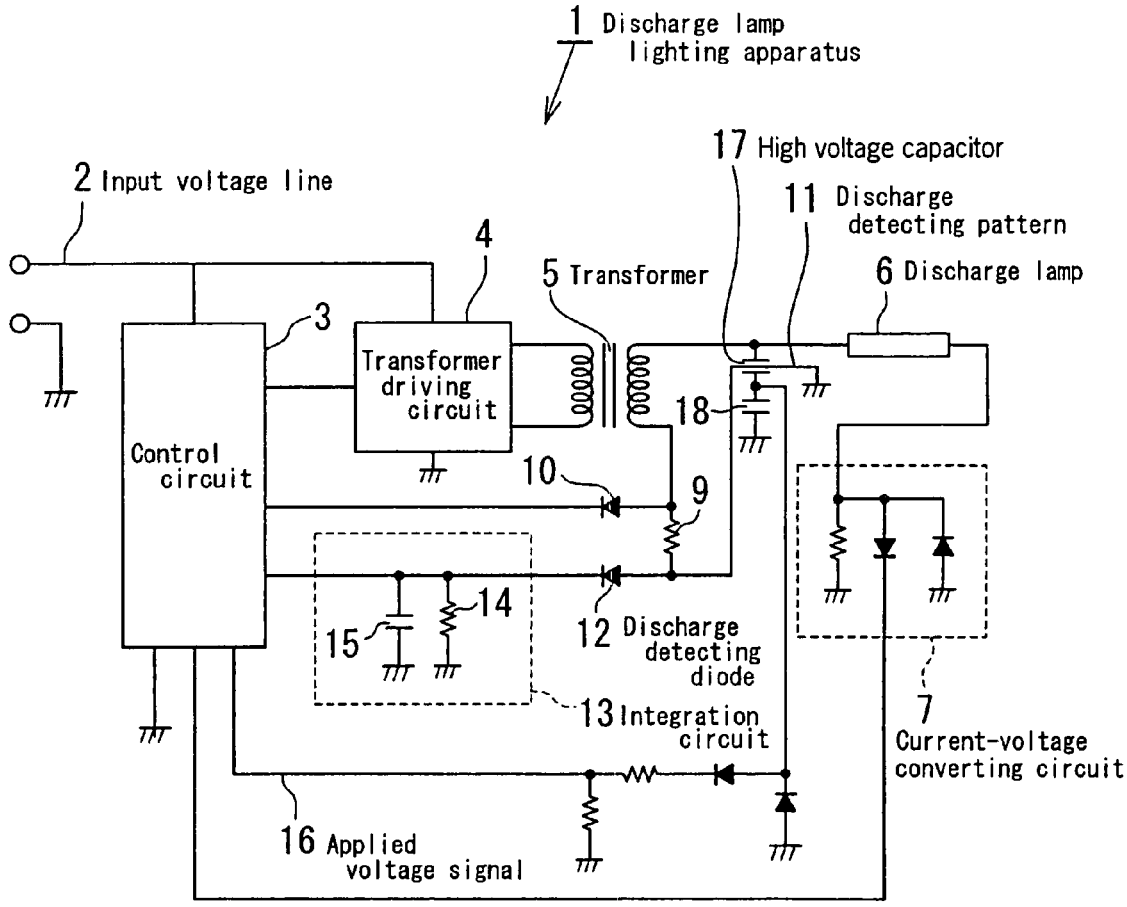
FIG. 1 is a block diagram of a discharge lamp lighting apparatus according to an embodiment of the present invention.

Referring to FIG. 1, a discharge lamp lighting apparatus 1 according to an embodiment of the present invention includes a transformer 5, a transformer driving circuit 4 connected at the primary side of the transformer 5, and a control circuit 3 connected to the transformer driving circuit 4, and a discharge lamp 6 is connected to the secondary side of the transformer 5. The control circuit 3 includes an oscillation circuit (not shown) to determine the driving frequency of the transformer driving circuit 4, and the transformer driving circuit 4 drives the primary side of the transformer 5 according to the control signal outputted from the control 3 thereby lighting the discharge lamp 6 connected at the secondary side of the transformer 5.

The discharge lamp 6 has its one terminal connected to one terminal of the secondary winding of the transformer 5 and has its other terminal connected to a current-voltage converting circuit 7 to convert a lamp current into a voltage. The output signal from the current-voltage converting circuit 7 is inputted to the control circuit 3, and the control circuit 3 controls the transformer driving circuit 4 according to the output signal from the current-voltage circuit 7 so as to keep constant a lamp current flowing in the discharge lamp 6.

An excess current detecting resistor 9 and an excess current detecting diode 10 are connected in parallel at the ground side of the secondary side of the transformer 5, the output signal from the diode 10 is inputted to a comparison circuit (not shown) of the control circuit 3 and compared with a predetermined reference voltage, and when the output signal exceeds the reference voltage, the control circuit 3 stops the operation of the transformer driving circuit 4 thereby preventing an excess current from flowing into the discharge lamp 6.

A series circuit composed of a high voltage capacitor 17 and a general purpose capacitor 18 is connected in parallel to the discharge lamp 6 at the junction of the one terminal of the secondary side of the transformer 5 and the discharge lamp 6, and a discharge detecting pattern 11, which has its one terminal connected to a discharge detecting diode 12 and has its other terminal grounded, is provided close to the high voltage capacitor 17. The high voltage capacitor 17 is a pattern capacitor which is composed of a plate-like dielectric body as a print board, and electrode patterns formed on the dielectric body as part of a conductive pattern. The structures of the high voltage capacitor 17 and the discharge detecting pattern 11 will be described in detail later. The general purpose capacitor 18 is a chip capacitor (electrolytic capacitor or film capacitor).

A series resonant circuit, which is composed of a leakage inductance of the transformer 5, a parasitic capacitance of the discharge lamp 6, and capacitances of the high voltage capacitor 17 and the general purpose capacitor 18, is formed at the secondary side of the transformer 5, and the transformer driving circuit 4 is controlled by the control circuit 3 so as to control the primary side of the transformer 5 at a specific frequency predetermined in relation to the resonant frequency of the series resonant circuit. Here, the capacitances of the high voltage capacitor 17 and the general purpose capacitor 18 function as an auxiliary capacitance for the parasitic capacitance of the discharge lamp 6, and the resonant frequency of the series resonant circuit formed at the secondary side of the transformer 5 can be flexibly set to an intended value by adjusting the capacitances of the high voltage capacitor 17 and the general purpose capacitor 18.

The specific frequency, which is determined in relation to the resonant frequency of the series resonant circuit, may be set to a frequency equal to the resonant frequency, but is preferably set to a frequency which is lower than the resonant frequency and which is within a range where the phase difference between the voltage and the current at the primary side of the transformer 5 is small (for example, within −30 degrees from the minimum point of the phase difference). Alternatively, the specific frequency may first be set to a frequency approximate to the resonant frequency before the discharge lamp 6 is lighted and may then, after the discharge lamp 6 is lighted, be set to a frequency which is lower than the resonant frequency and which is within a range where the phase difference between the voltage and current at the primary side of the transformer 5 is small (for example, within −30 degrees from the minimum point of the phase difference).

Further, the high voltage capacitor 17 and the general purpose capacitor 18 function also as a voltage detecting means when the secondary side of the transformer 5 is open. An applied voltage signal 16 produced by the voltage division at the high voltage capacitor 17 and the general purpose capacitor 18 is inputted to the comparison circuit (not shown) of the control circuit 3 and compared with a reference voltage predetermined, and when the applied voltage signal 16 exceeds the reference voltage, the control circuit 3 causes the transformer driving circuit 4 to stop its operation thereby preventing excess voltage at the transformer 5.

The structure of a high voltage capacitor and a discharge detecting pattern according to the present invention, and the means to detect discharge thereby stopping power supply to the secondary side of a transformer will be described with reference to FIGS. 2A and 2B to FIGS. 6A and 6B.

Referring to FIGS. 2A, 2B and FIGS. 9A-9C showing a first example of a structure of a high voltage capacitor and a discharge detecting pattern, a print board 20 is a double-sided printed wiring board and includes a plate-like dielectric body 23 made of paper-based phenol resin, glass fabric-based epoxy resin, or like material, and conductive patterns which are made of copper foil, or like material, formed on the both surfaces of the dielectric body 23, and which constitute electrode patterns, specifically an upper electrode 21 and a lower electrode 22. The high voltage capacitor 17 described above is structured such that the upper electrode 21 and the lower electrode 22 sandwich the dielectric body 23. The print board 20 further includes a discharge detecting pattern 11 formed on one surface of the dielectric body 23 that has the lower electrode 21. Here, the nominal designation of the upper and lower electrodes 21 and 22 is for the convenience of explanation and does not necessarily indicate the orientation of the print board 20 actually mounted. In this particular example, the upper electrode 21 is defined as an electrode pattern connected to the transformer 5 while the lower electrode 22 is defined as an electrode pattern connected to the general purpose capacitor 18. The discharge detecting pattern 11, which is formed on the surface of the dielectric body 23 with the lower electrode 22 in FIGS. 2A and 2B, may alternatively be formed on the surface of the dielectric body that has the upper electrode 21. The conductive patterns leading out from the upper and lower electrodes 21 and 22 can be flexibly designed according to the wiring spaces on the print board 20 and other considerations, and therefore are omitted in FIGS. 2A and 2B to FIGS. 6A and 6B.

In the discharge lamp lighting apparatus 1, when a corona or arc discharge is caused at a broken wire at the secondary side of the transformer 5, a noise component is mixed into a lamp current, and a current including a high frequency component is caused to flow also in the high voltage capacitor 17 by a high frequency component included in the noise component. As a result, an induced voltage is generated in the discharge detecting pattern 11 disposed close to the high voltage capacitor 17 by the current including a high frequency component. The induced voltage is inputted to the comparison circuit (not shown) of the control circuit 3 via the discharge detecting diode 12 and then via an integration circuit 13 composed of a resistor 14 and a capacitor 15, and is compared with a reference voltage predetermined. When a voltage signal from the integration circuit 13 exceeds the reference voltage, the control circuit 3 causes the transformer driving circuit 4 to stop its operation so as to stop power supply to the secondary side of the transformer 5, whereby the corona or arc discharge caused in the circuit at the secondary side of the transformer 5 is stopped from continuing to occur thus protecting the discharge lamp lighting apparatus 1.

In the discharge lamp lighting apparatus 1, an abnormal discharge such as a corona or arc discharge caused at a high voltage portion can be accurately detected by the discharge detecting pattern 11 disposed close to the high voltage capacitor 17 connected at the high voltage side of the transformer 5.

Figure 2A:
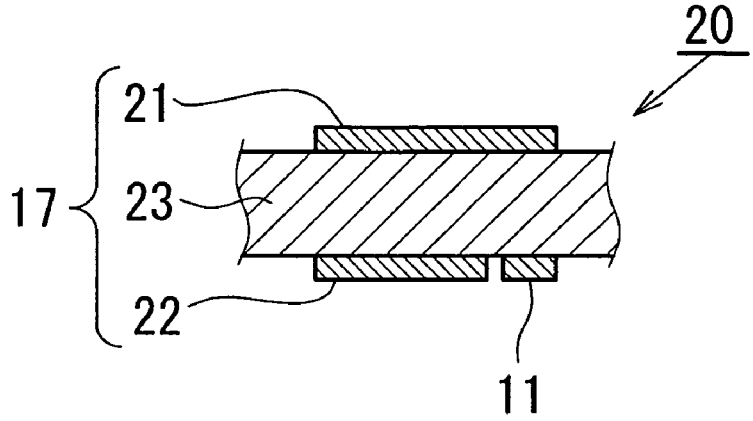
FIG. 2A is a cross sectional view of a first example of a structure of a high voltage capacitor and a discharge detecting pattern in the discharge lamp lighting apparatus according to the present invention.
Figure 2B:
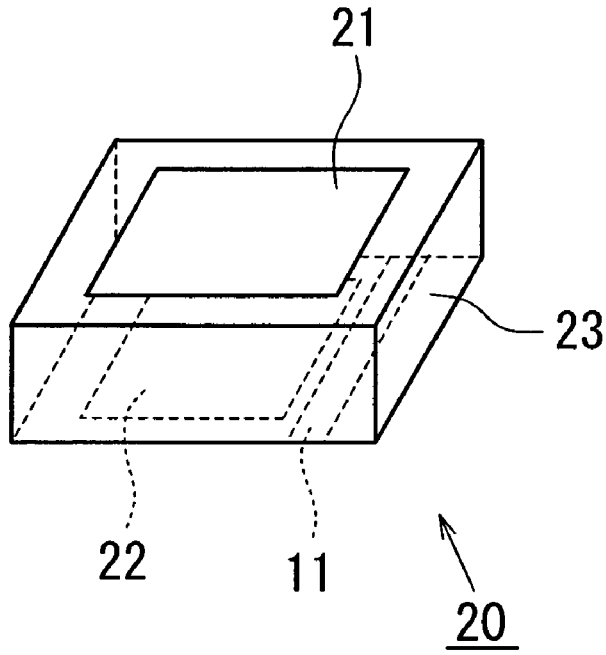
FIG. 2B is a perspective view of the structure described in FIG. 2A.

The present invention is not limited to the structure of a high voltage capacitor described with reference to FIGS. 2A and 2B, and a high voltage capacitor may alternatively be structured with, for example, a multilayer printed wiring board, which will hereinafter be explained with reference to FIGS. 3A to 3C, where a high voltage capacitor and a discharge detecting pattern are formed together with a multilayer printed wiring board made of glass fabric epoxy resin laminate sheet, or the like.

Figure 3A:
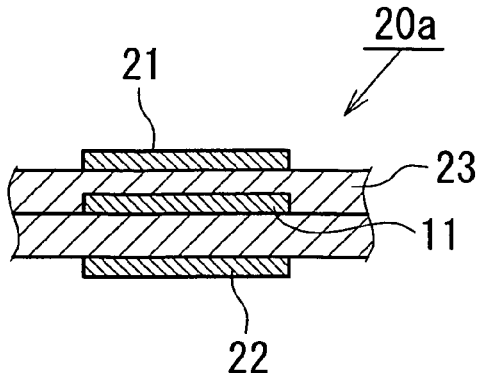
FIGS. 3A, 3B and 3C are cross sectional views of second, third and fourth examples of structures of a high voltage capacitor and a discharge detecting pattern in the discharge lamp lighting apparatus according to the present invention.

Referring to FIG. 3A showing a second example of a structure of a high voltage capacitor and a discharge detecting pattern, a print board 20*a* includes two dielectric bodies 23 attached to each other, upper and lower electrodes 21 and 22 formed on the respective outer surfaces of the two dielectric bodies 23, and a discharge detecting pattern 11 formed at the interface between the two dielectric bodies 23 so as to be sandwiched between the upper and lower electrodes 21 and 22.

Figure 3B:
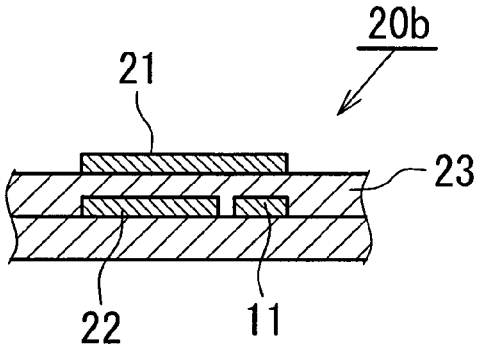

Referring to FIG. 3B showing a third example of a structure of a high voltage capacitor and a discharge detecting pattern, a print board 20*b* includes two dielectric bodies 23 layered on each other, an upper electrode 21 formed at an outer surface of one of the two dielectric bodies 23, and a lower electrode 22 and a discharge detecting pattern 11 both formed at the interface between the two dielectric bodies 23 so as to be located in an area corresponding to the upper electrode 21.

Figure 3C:
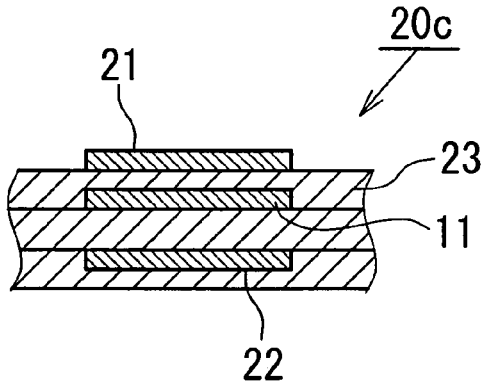

Referring to FIG. 3C showing a fourth example of a structure of a high voltage capacitor and a discharge detecting pattern, a print board 20*c* includes three dielectric bodies 23, an upper electrode 21 formed at an outer surface of one (top in the figure) of the three dielectric bodies 23, a lower electrode 22 formed at the interface between the other two (bottom and middle in the figure) of the three dielectric bodies 23, and a discharge detecting pattern 11 formed at the interface between the top and middle dielectric bodies 23 so as to be sandwiched between the upper and lower electrodes 21 and 22.

The advantage of the structure of a high voltage capacitor, in which one (lower electrode 22 in FIGS. 3B, 3C and 9A) of two electrodes is formed at an interface between the two dielectric bodies, will be described with reference to FIGS. 4A to 4C.

Figure 4A:
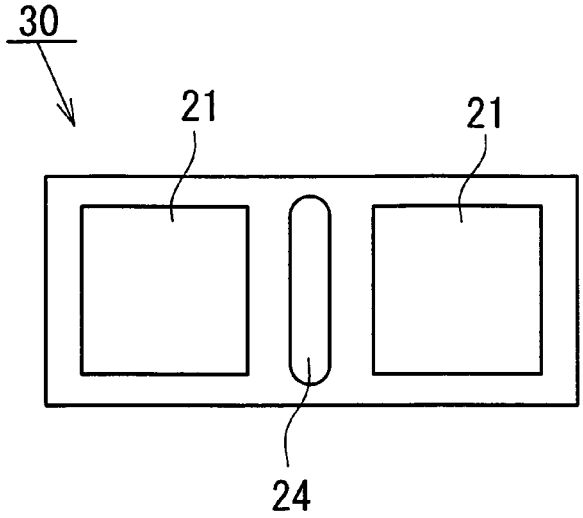
Figure 4B:
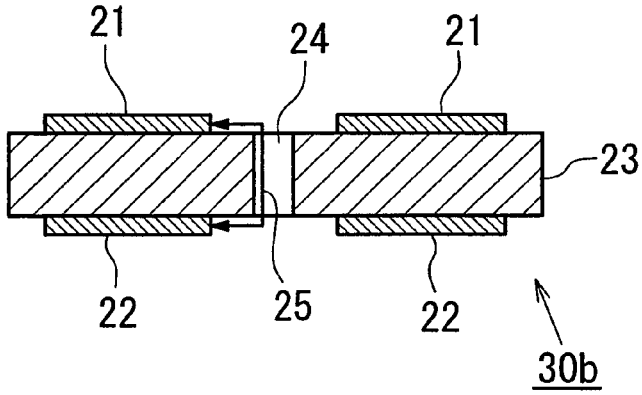
Figure 4C:
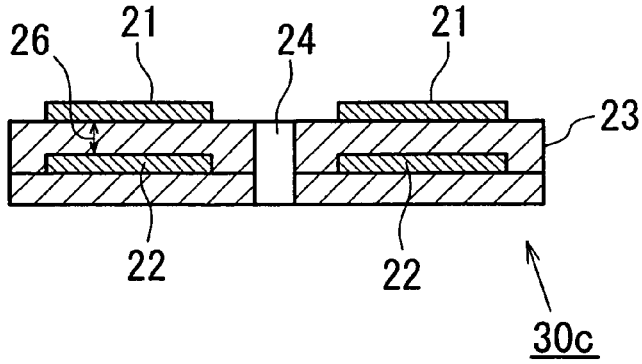

In a discharge lamp lighting apparatus to light a plurality of discharge lamps, where a plurality of high voltage capacitors are used, a slit 24 may be formed in a print board 30 as shown in FIG. 4A so as to increase the creepage distance between the upper electrodes 21 and 21 of adjacent high voltage capacitors for the purpose of enhancing the insulation performance between the adjacent upper electrodes 21 and 21 formed at a limited wiring space in the print board 30. In such an arrangement, if the lower electrodes 22 are formed respectively on the outer surfaces of the dielectric body 23 as shown in FIG. 4B, a surface path is formed from the upper electrode 21 to the lower electrode 22 via the slit 24, and therefore it is necessary to ensure that a creepage distance 25 is long enough in consideration of the insulation between the upper and lower electrodes 21 and 22. On the other hand, if the lower electrodes 22 are formed at the interface between the two dielectric bodies 23 so as to be fully enclosed as shown in FIG. 4C, there is no need to consider the insulation between the upper and lower electrodes 21 and 22 in terms of creepage distance while consideration is put only on an insulation distance 26 between the electrodes 21 and 22 through the dielectric body 23 which has a higher withstand voltage than an open space (air). Thus, when a plurality of high voltage capacitors are disposed at a limited space with a slit 24 provided between adjacent high voltage capacitors, it is advantageous, in view of enhancing the insulation performance between the upper and lower electrodes 21 and 22, to form one of the upper and lower electrodes 21 and 22 at the interface between the two adjacent dielectric bodies 23 compared with a structure in which the upper and lower electrodes 21 and 22 are formed on the respective outer surfaces of one dielectric body 23.

Figure 5A:
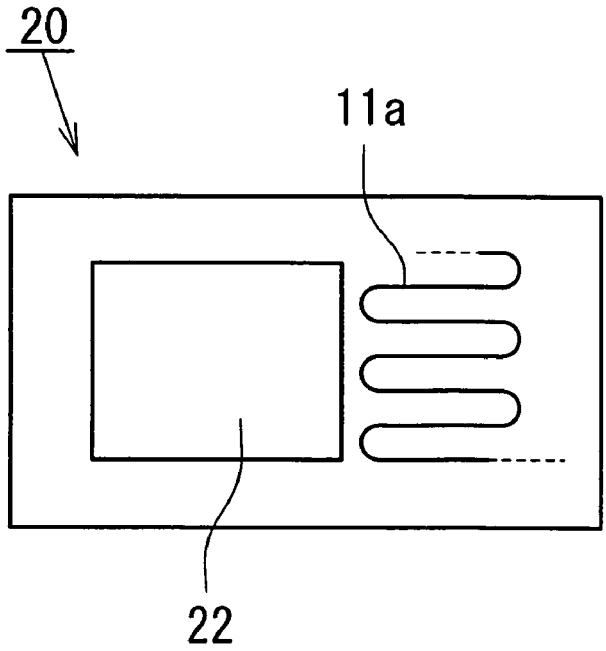
Figure 5B:
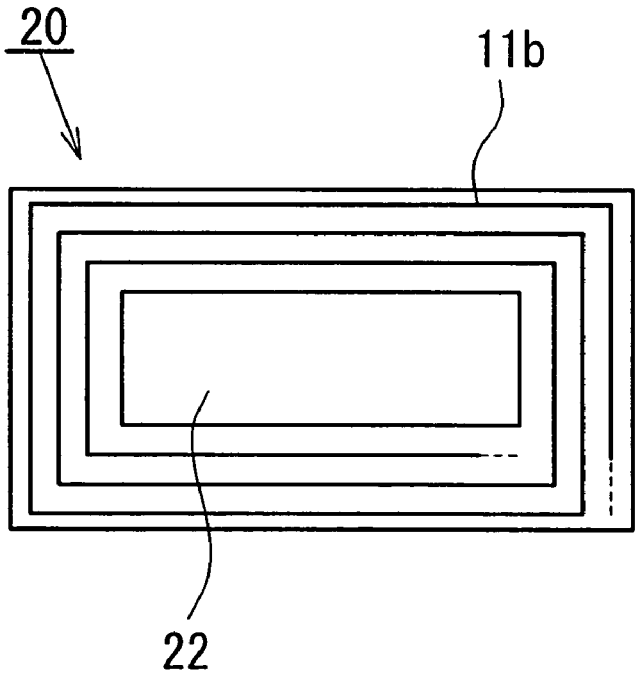
Figure 9A:
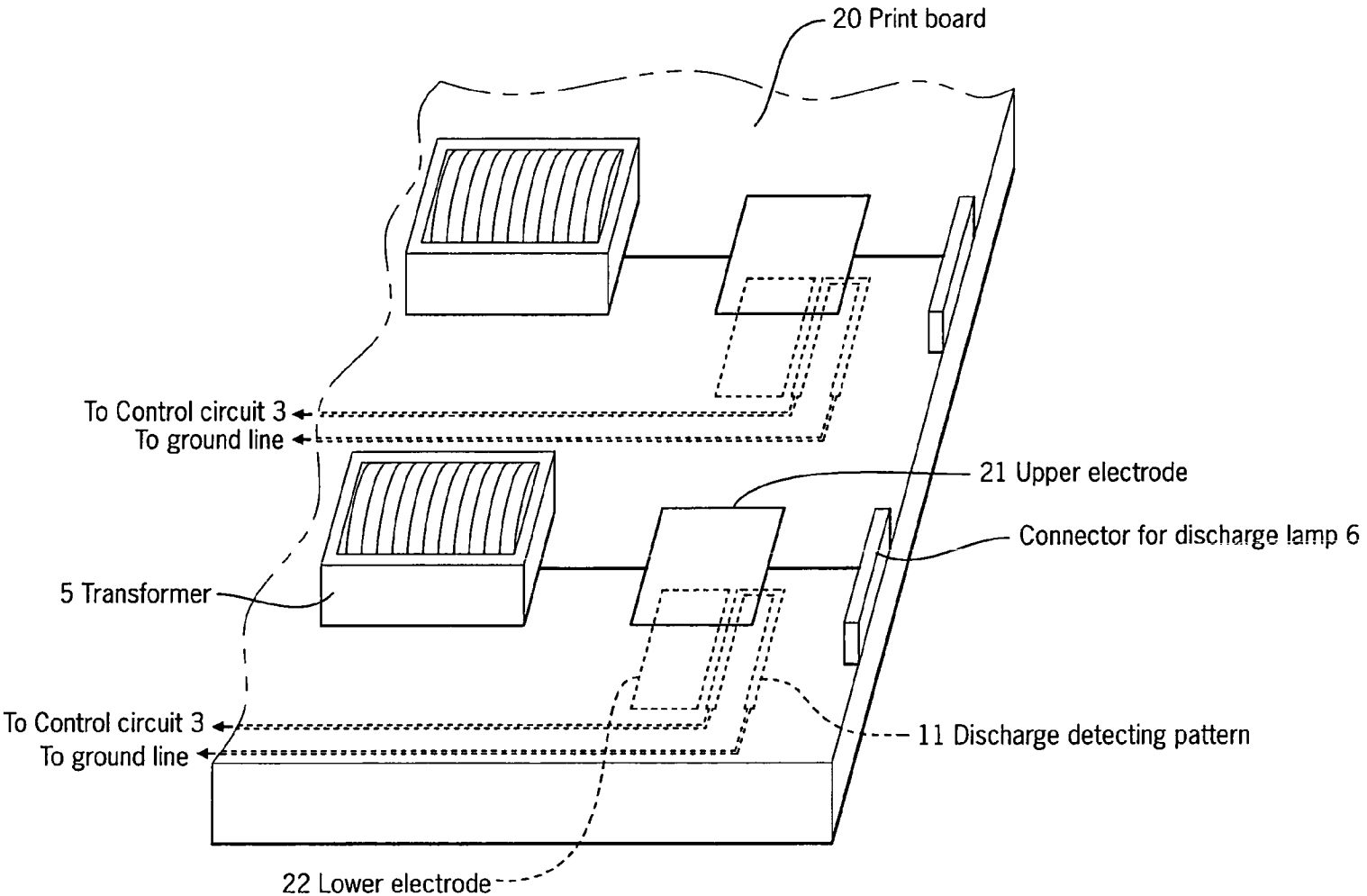
FIG. 9A. 9B and FIG. 9C and perspective views of the structural relationships between print boards, high voltage capacitors, discharge lamps and electrodes.
Figure 9B:
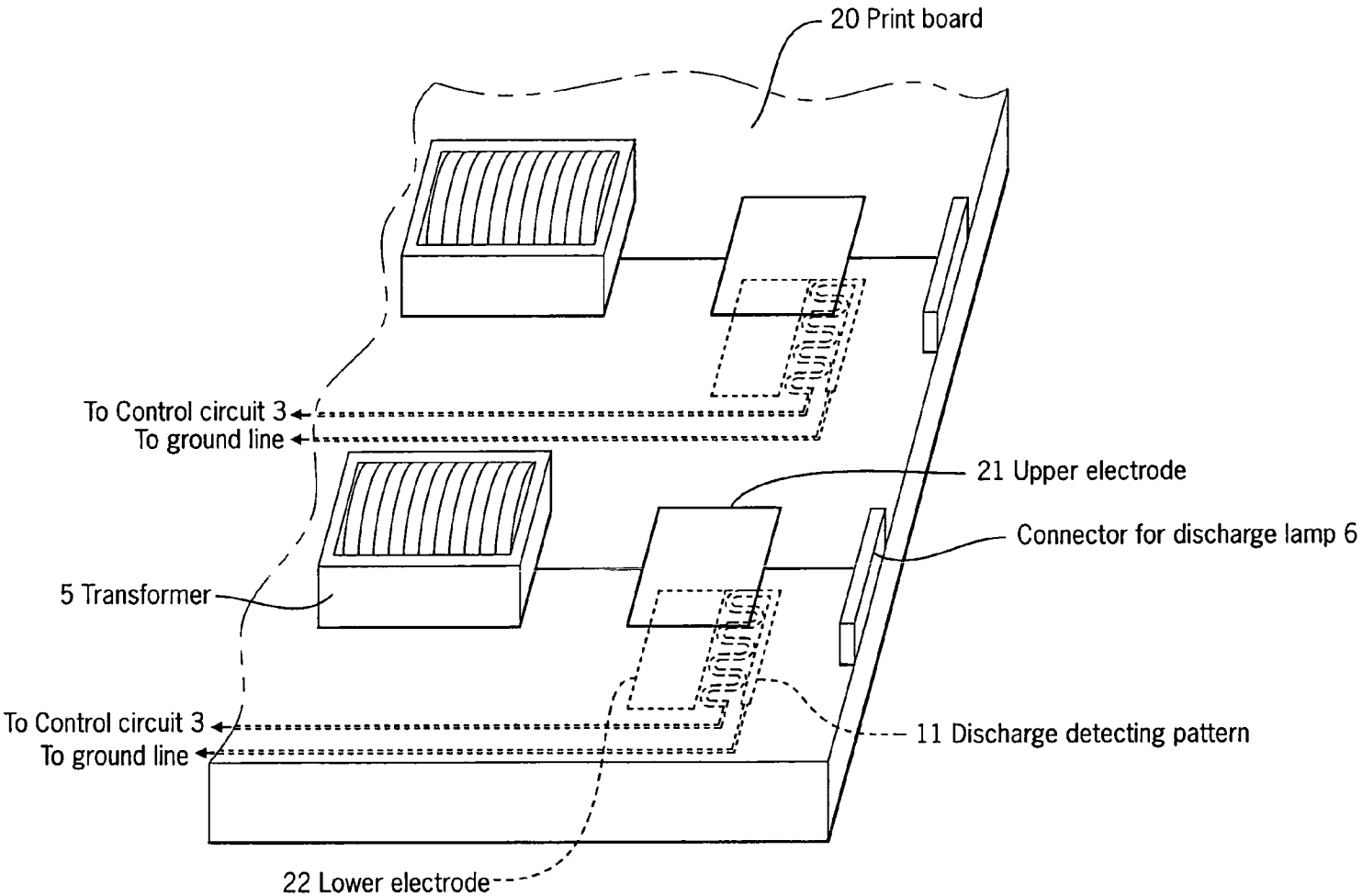

The present invention is not limited to the configuration (straight line) of a discharge detecting pattern described with reference to FIG. 2B, and a discharge detecting pattern with an optional configuration may be used. For example, FIG. 5A and FIG. 9B show a discharge detecting pattern 11*a* which is put into a meandering configuration, and FIG. 5B shows a discharge detecting pattern 11*b* which is put into a swirling configuration. Also, the present invention is not limited to any specific disposition of a discharge detecting pattern (for example, disposition at one side of an electrode as shown in FIG. 2A), and a discharge detecting pattern may be disposed, for example, around an electrode as shown in FIG. 5B, where the discharge detecting pattern 11*b* swirls around the electrode 22.

The present invention can incorporate an appropriate combination of a high voltage capacitor and a discharge detecting pattern with respect to structure and disposition, for example, out of those as shown in FIGS. 2A and 2B to FIGS. 5A and 5B, whereby a discharge detecting pattern can be formed with a desired inductance according to a wiring space available on a print board so that discharges can be efficiently detected.

Figure 6A:
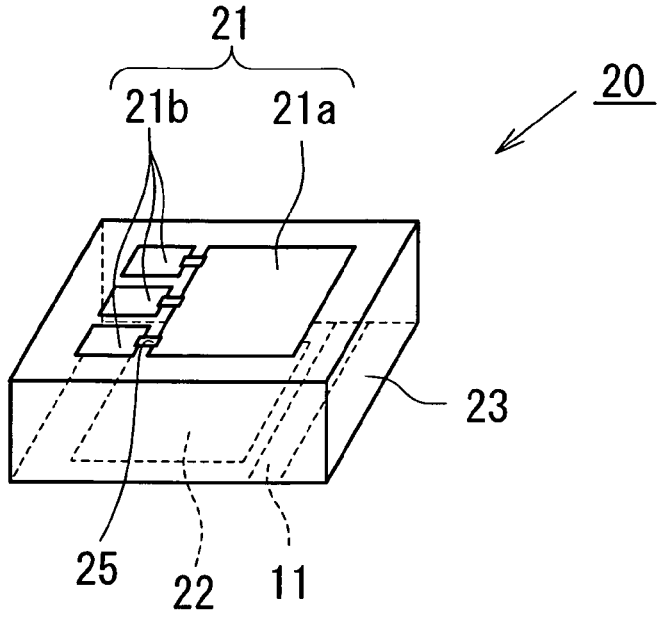
FIGS. 6A and 6B are perspective views of print boards with respective multi-segment electrodes composed of a plurality of electrode patterns for a high voltage capacitor in the discharge lamp lighting apparatus according to the present invention.

The structure of an electrode pattern of a high voltage capacitor according to the present invention will be described with reference to FIGS. 6A and 6B.

In the present invention, it is preferable that at least one of two electrodes of a high voltage capacitor be formed into a multi-segment structure composed of a plurality of electrode patterns. For example, referring to FIG. 6A, an upper electrode 21 is composed of an electrode pattern 21*a* and three electrode patterns 21*b* each having a smaller area than the electrode pattern 21*a*, and the three electrode patterns 21*b* are connected to the electrode 21*a* via respective jumper leads 25 thereby forming the upper electrode 21 as one component. In the structure described above, the capacitance of the pattern capacitor varies in proportion to the total area of the electrode patterns 21*a* and 21*b* connected, and therefore can be adjusted for a desired value by changing the connection mode. Consequently, if the parasitic capacitance of the discharge lamp 6 is caused to change due to some changes in design of the discharge lamp lighting apparatus 1, the capacitance value of the high voltage capacitor 17 can be readily adjusted without redesigning the print board 20.

Figure 6B:
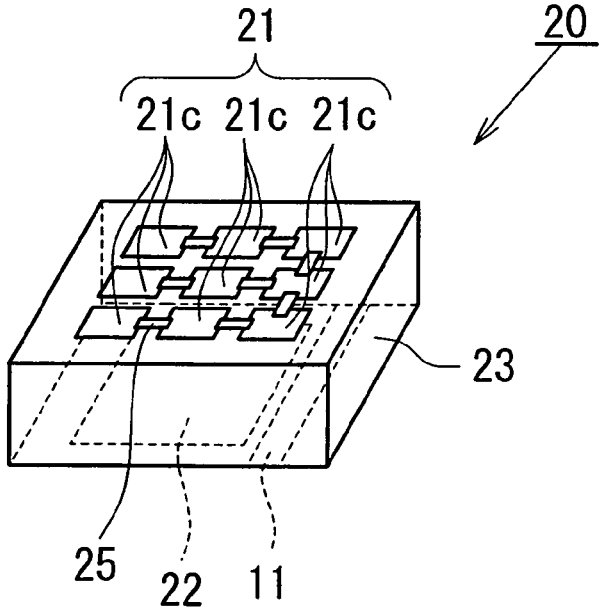
Figure 7:
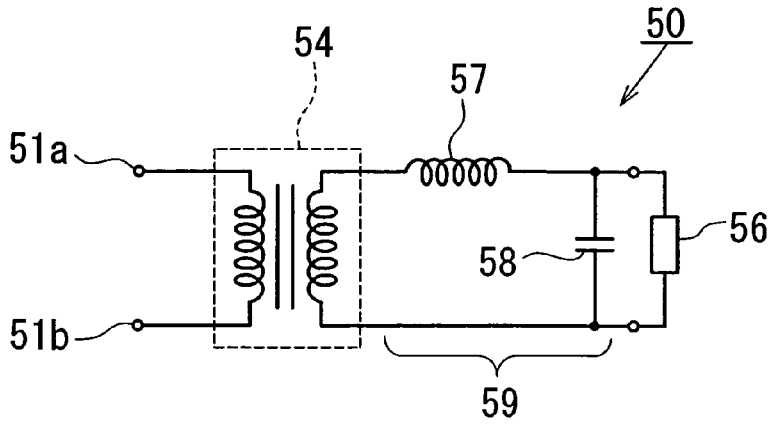
FIG. 7 Prior Art
FIG. 7 is a circuitry of a typical discharge lamp lighting apparatus.
Figure 8:
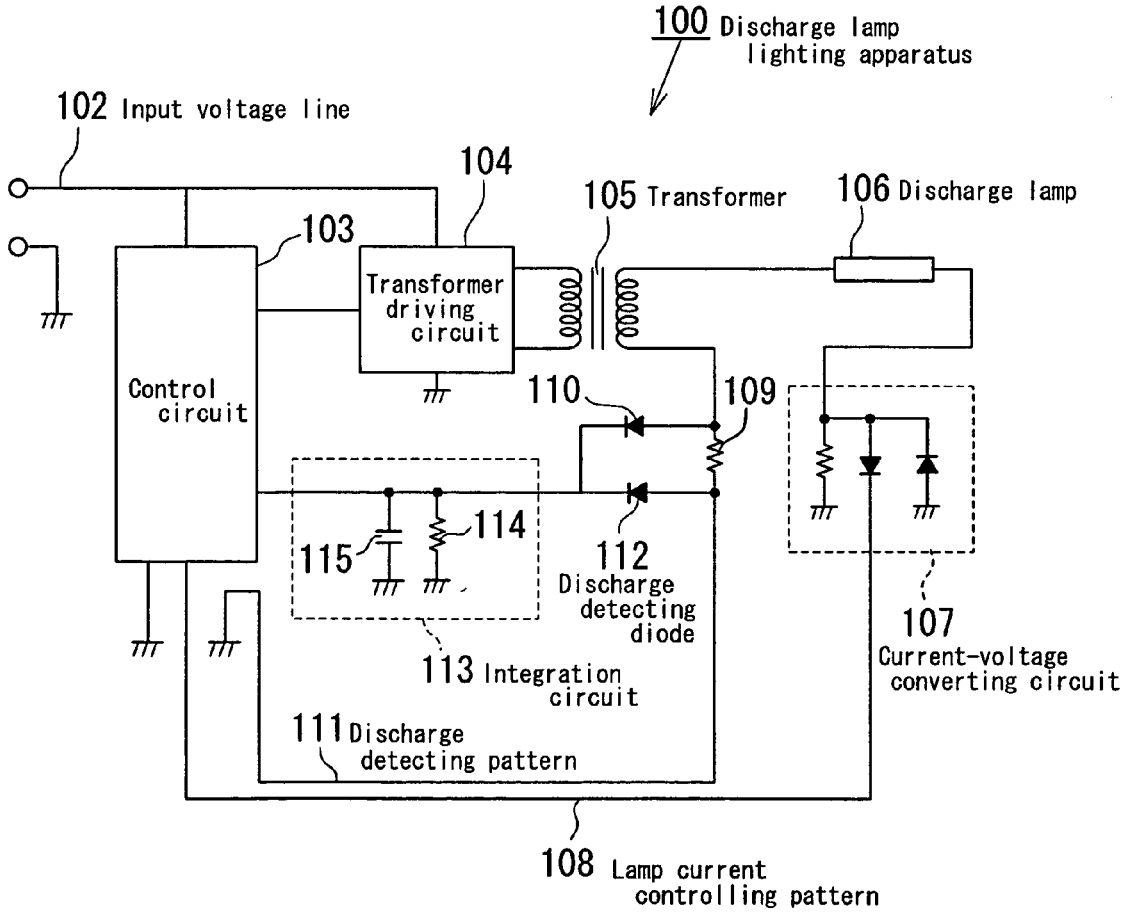
FIG. 8 Prior Art
FIG. 8 is a block diagram of another typical discharge lamp lighting apparatus.
Figure 9C:
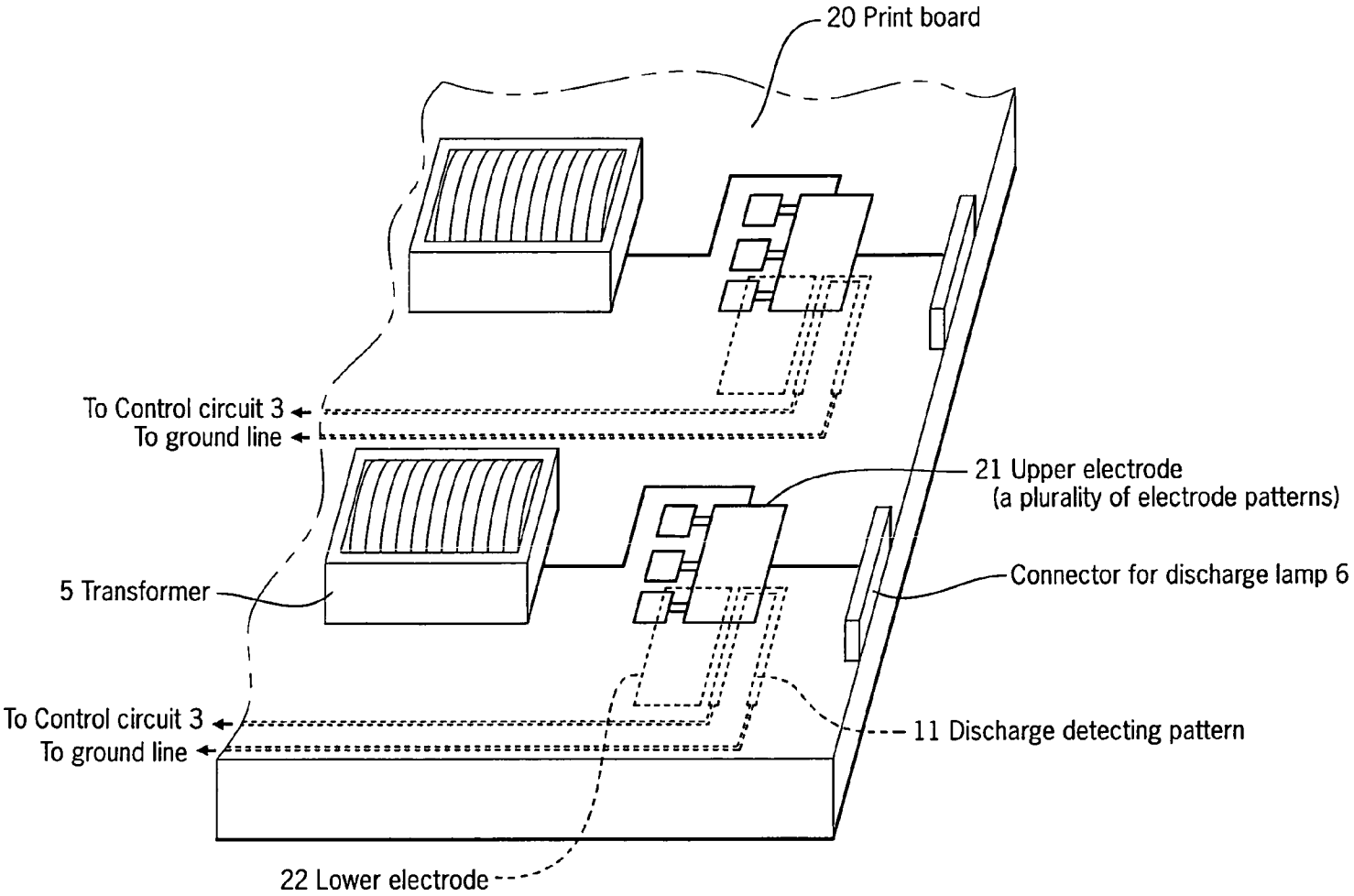

The present invention is not limited to the multi-segment structure of an electrode described with reference to FIG. 6A and FIG. 9C (e.g., configuration, dimension, and number of patterns), and an upper electrode 21 may be composed of, for example, nine electrode patterns 21*c* with a small dimension as shown in FIG. 6B, which enables a finer adjustment of the capacitance than the structure shown in FIG. 6A and FIG. 9C. Further, the individual electrode patterns are connected by the jumper leads 25 in the examples shown in FIGS. 6A and 6B, but the present invention is not limited to the connection method, and the individual electrode patterns may be connected by, for example, chip jumpers. Alternatively, the individual electrode patterns may be prepared with in-between connecting conductive patterns, some of which will then be cut off as needed so as to achieve an appropriate connection mode for a desired capacitance value.

What is claimed is:

1. A discharge lamp lighting apparatus comprising:

a transformer defining primary and secondary sides;

a transformer driving circuit to drive the primary side of the transformer thereby lighting a discharge lamp connected at the secondary side of the transformer;

a control circuit to control the transformer driving circuit;

a high voltage capacitor formed of a pattern capacitor and disposed between one terminal of the secondary side of the transformer and the discharge lamp, wherein at least one electrode of the high voltage capacitor comprises a plurality of electrode patterns; and a discharge detecting pattern disposed close to the high voltage capacitor, wherein a voltage induced in the discharge detecting pattern is detected, and power supply to the secondary side of the transformer is stopped.

2. A discharge lamp lighting apparatus according to claim 1, wherein electrodes of the high voltage capacitor are formed respectively at both surfaces of a print board.

3. A discharge lamp lighting apparatus according to claim 1, wherein at least one electrode of the high voltage capacitor is formed at an interface between adjacent layers of a print board.

4. A discharge lamp lighting apparatus according to claim 1, wherein the discharge detecting pattern and one electrode of the high voltage capacitor are formed on a same surface of a print board.

5. A discharge lamp lighting apparatus according to claim 1, wherein the discharge detecting pattern is formed at an interface between adjacent layers of a print board so as to be sandwiched between electrodes of the high voltage capacitor.

6. A discharge lamp lighting apparatus according to claim 1, wherein the discharge detecting pattern comprises a portion having a meandering configuration.

7. A discharge lamp lighting apparatus according to claim 1, wherein the discharge detecting pattern comprises a portion having a swirling configuration.

* * * * *